US007201601B2

(12) United States Patent
Lappöhn

(10) Patent No.: US 7,201,601 B2
(45) Date of Patent: Apr. 10, 2007

(54) INSULATION DISPLACEMENT MULTIPOINT CONNECTOR FOR ELECTRICAL PLUG CONNECTORS

(75) Inventor: Jürgen Lappöhn, Gammelshausen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 11/272,454

(22) Filed: Nov. 10, 2005

(65) Prior Publication Data

US 2006/0134966 A1 Jun. 22, 2006

(30) Foreign Application Priority Data

Nov. 10, 2004 (DE) ..... 10 2004 054 203

(51) Int. Cl.
*H01R 4/24* (2006.01)
*H01R 4/26* (2006.01)
*H01R 11/20* (2006.01)

(52) U.S. Cl. ..... 439/404; 439/714

(58) Field of Classification Search ..... 439/404, 439/405, 417, 401

See application file for complete search history.

(56) References Cited

U.S. PATENT DOCUMENTS 4,632,486 A * 12/1986 Hasircoglu ..... 439/394
4,668,039 A * 5/1987 Marzili ..... 439/404
4,902,243 A * 2/1990 Davis ..... 439/405
5,554,047 A 9/1996 Englert, Jr.
6,666,706 B1 * 12/2003 Jones et al. ..... 439/405
6,716,054 B1 * 4/2004 Denovich et al. ..... 439/404
6,811,429 B2 * 11/2004 Recktenwald et al. ..... 439/405
2004/0248456 A1 * 12/2004 Tashiro et al. ..... 439/405

FOREIGN PATENT DOCUMENTS

DE 197 32 182 3/1999
DE 199 53 593 9/2000
WO 03/103093 12/2003

* cited by examiner

*Primary Examiner*—Hae Moon Hyeon
(74) *Attorney, Agent, or Firm*—Friedrich Kueffner

(57) ABSTRACT

An insulation displacement multipoint connector for electrical plug connectors includes connection elements which form at one end thereof an insulation displacement termination area for a connection of electrical conductors without requiring stripping and, at the other end, a plug contact area for a multipoint counter connector. The insulation displacement termination area has flat, slotted insulation displacement terminals. The connection elements are arranged such that for one row of plug contacts of the connection elements embedded next to each other, the insulation displacement terminals of these connection elements are located in several rows in the insulation displacement multipoint connector.

15 Claims, 5 Drawing Sheets

INSULATION DISPLACEMENT MULTIPOINT CONNECTOR FOR ELECTRICAL PLUG CONNECTORS

BACKGROUND OF THE INVENTION

1. Field of the Invention

The present invention relates to an insulation displacement multipoint connector for electrical plug connectors, with combined connection elements which form at one end an insulation displacement termination area for a connection of electrical conductors without requiring stripping and, at the other end, a plug contact area for a multipoint counter connector, wherein the insulation displacement termination area has flat, slotted insulation displacement terminals.

2. Description of the Related Art

Insulation displacement connectors are frequently used for contacting electrical conductors without requiring stripping which comprise an area of a metal stamped and bent part equipped with an insulation displacement terminal contact slot for contacting with an electrical conductor to be connected, and an area of a metal stamped and bent part equipped with a plug contact component for corresponding multipoint counter connector elements. In this way, several connection elements are housed in an insulating case arranged in a single row or in multiple rows and so form a multipoint connector. Such an electric multipoint connector is described for example in DE 199 53 593 A1. The connection elements according to this publication each consist of one stamped metal strip bent in a u-shape which is bent perpendicularly and identically around two parallel bend regions positioned transversely to the longitudinal direction of the stamped metal strip and spaced apart from each other, such that a spring arm base plate for two contact spring arms each with a keyhole-like insulation displacement termination device is formed.

The connection elements accordingly have a complicated design and require a considerable amount of space.

DE 197 32 182 C1 shows, for example, series terminals with two flat, mostly parallel insulation displacement contact legs which are bent from a base.

SUMMARY OF THE INVENTION

The invention is based on the object to provide an insulation displacement multipoint connector with one or multiple rows for electric plug connectors comprising connection elements which can be manufactured relatively easily and are of the narrowest possible build with constant functionality. Furthermore, such an insulation displacement multipoint connector shall be producible by means of modern manufacturing techniques and in a miniaturized design.

This object is met by an insulation displacement multipoint connector for electric plug connectors which has connection elements arranged in one or multiple rows. The connection elements are such that for one row of plug contacts of the connection elements embedded next to each other, the insulation displacement terminals of these connection elements are located in several rows in the insulation displacement multipoint connector. The plug contacts of the connection elements are located in a row next to each other in the insulation displacement multipoint connector and the insulation displacement terminals of the connection elements are in two rows. The insulation displacement terminals of the connection elements are alternatingly located in two rows in the insulation displacement multipoint connector and the connection elements are inserted with regard to their plug contacts alternatingly offset in opposite directions within a connection element row.

An important crucial point of the invention is also seen in the fact that by means of the disclosed constructional configuration of the bottom case part and the upper case part of insulation displacement multipoint connector, particularly the design and arrangement of the elements on the upper case part for the intake of connection elements and the design of the connection elements themselves, significant advantages are attainable for the inherent fabrication and that of a narrow constructional design. The details for this will still be provided later in the description.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

Throughout all the figures of the drawings identical components are furnished with the same reference numbers.

In the drawing.

DETAILED DESCRIPTION OF THE INVENTION

The single-rowed plug connector strip shown in FIGS. 1 to 5 is composed of a multipoint counter connector 1, and an insulation displacement multipoint connector 2 for connecting, in this example, four electric conductors which are inserted into the interior of the insulation displacement multipoint connector 2 through insertion openings 2*a*. The multipoint counter connector 1 has a case trough la made of insulating material, in which a row of parallel counter plug contacts, not shown herein, are attached and which point in the direction of the plug connection. In the example, four counter plug contacts are arranged in one row. The case trough 1*a* exhibits on the side opposite the plug connection openings 1*b* for the terminal lugs 1*c* which are integrally moulded to the counter plug contacts. With the help of a snap-in slot 1*d* which corresponds with a notch 2*b* on the bottom case part 2*c* of the insulation displacement multipoint connector 2, locks the multipoint counter connector 1 in the plugged state without projecting the insulation displacement multipoint connector 2. This locking with the locking elements 1*d* and 2*b* prevents a loosening of the plug connection in the event that vibrations act on the plug connection on the one hand, or that tensile forces act against the plugging direction, which, although below a defined threshold value for disconnecting the multipoint counter connector 1 from the insulation displacement multipoint connector 2, could negatively impact the quality of the plug connection.

Furthermore, the case trough 1*a* bears at its narrow sides spring-elastic fastening clamps 3 for fastening the plug connector to a base. These fastening clamps 3 snap with their snap-in slots 3*a* into corresponding locking contours 1*e* of the case trough 1*a*.

Figure 1:
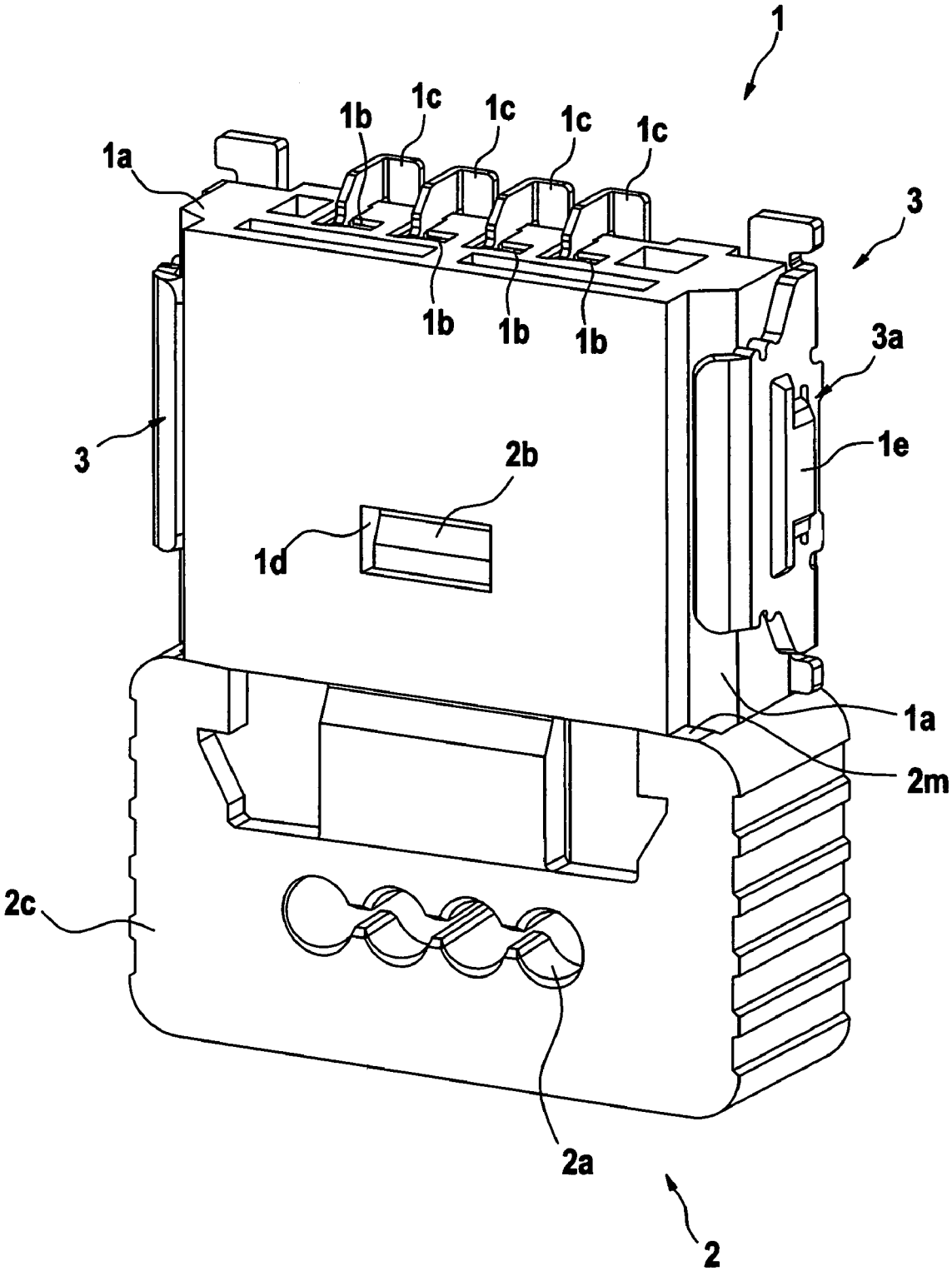
FIG. 1 is a perspective lateral view of a complete single-row plug connector.
Figure 2:
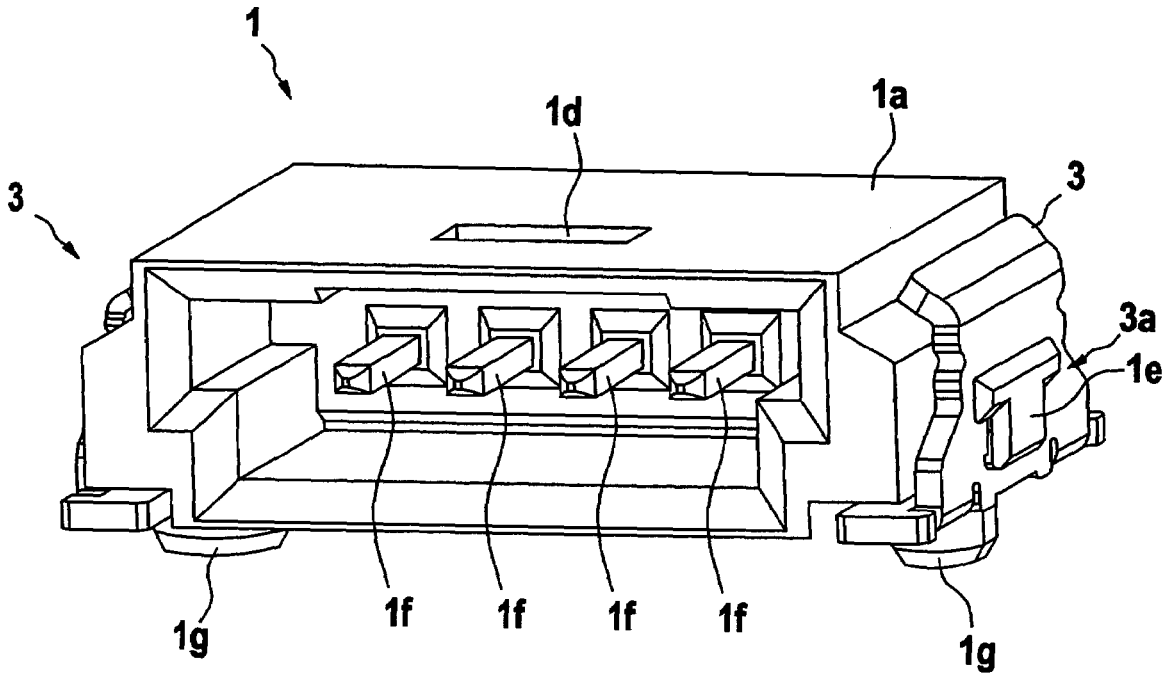
FIG. 2 is a view onto the interior of the multipoint counter connector of a plug connector.

FIG. 2 shows a view into the interior of the multipoint counter connector 1. The four counter plug contacts if which in the present illustration are designed as contact blades can be seen well, inserted in a row in the trough-like insulating case 1*a* of the multipoint counter connector 1. In addition, small feet 1*g* are attached at the backside of the trough case 1*a*. Furthermore, FIG. 2 shows how the fastening clamps 3 with their snap-in slots 3*a* are snapped over the locking contours 1*e* at the narrow sides of the trough case 1*a*.

Figure 3:
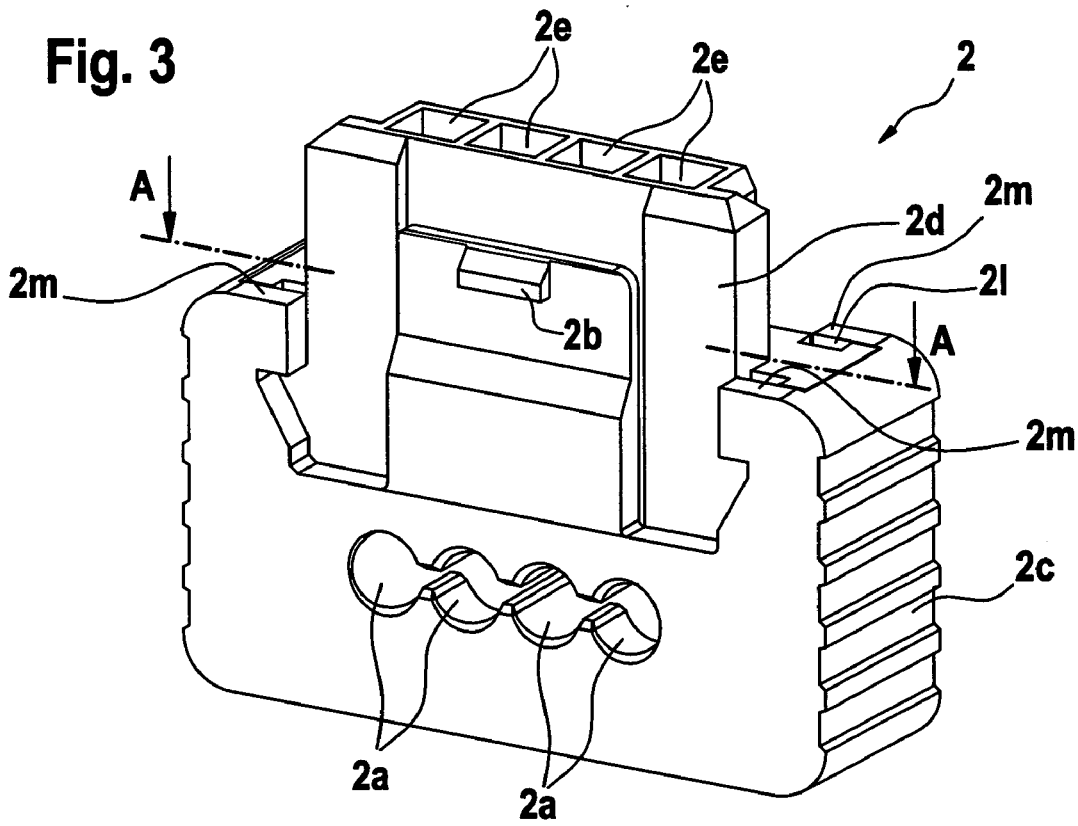
FIG. 3 is a perspective illustration of an insulation displacement multipoint connector of a plug connector according to FIG. 1 with a removed multipoint counter connector.

FIG. 3 shows the closed insulation displacement multipoint connector 2. It comprises two attachable case parts 2*c*, 2*d*, the bottom case part 2*c* having insertion openings 2*a* for the electric conductors to be connected electrically without stripping and the notch 2*b*, as well as the upper case part 2*d* having the inserted connection elements, not shown herein, whose plug contacts open into the plug-in chambers 2*e*. It can also be seen clearly in FIG. 3 that the notch 2*b*—which creates a lock-in position with the snap-in slot 1*d* of the multipoint counter connector 1 in a plugged state—is now, according to the constructional design, integrated in the broad side of the body of the bottom case part 2*c*. By displacing this locking element 2*b* from the narrow side of the body to the broad side of the body, the grip elements which are provided according to conventional design on the narrow sides of the insulation displacement multipoint connector 2 can be formed in a more variable manner. Additionally, the entire width of such an insulation displacement multipoint connector 2 can also be reduced, which has a very positive affect on the production of miniaturized designs of such plug connections.

Figure 3A:
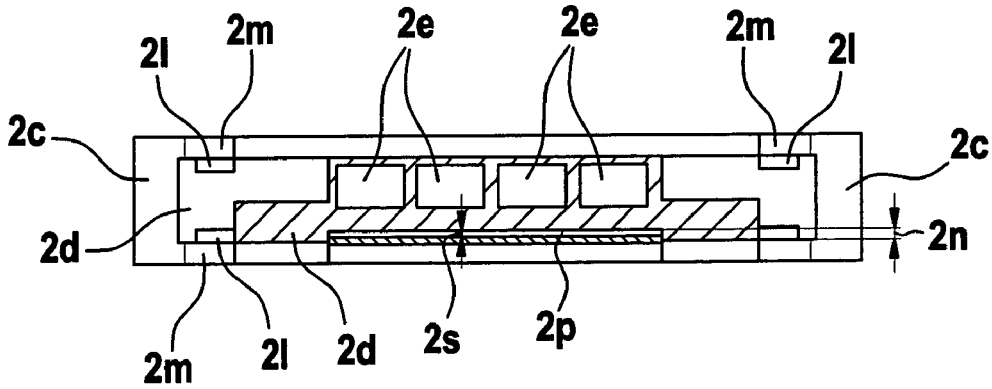
FIG. 3A is a top view of the connector.

Moreover, a specialized design envisions that a recess 2*n* is arranged in the upper case part 2*d* of the insulation displacement multipoint connector 2 corresponding to the position of the notch 2*b* in the bottom case part 2*c*, wherein a space 2*n* is formed between the surfaces of the recess and the notch 2*b* which face each other, so that the notch 2*b* has more latitude 2*p* for a transverse motion 2*c*. as shown in FIG. 3A.

Figure 4:
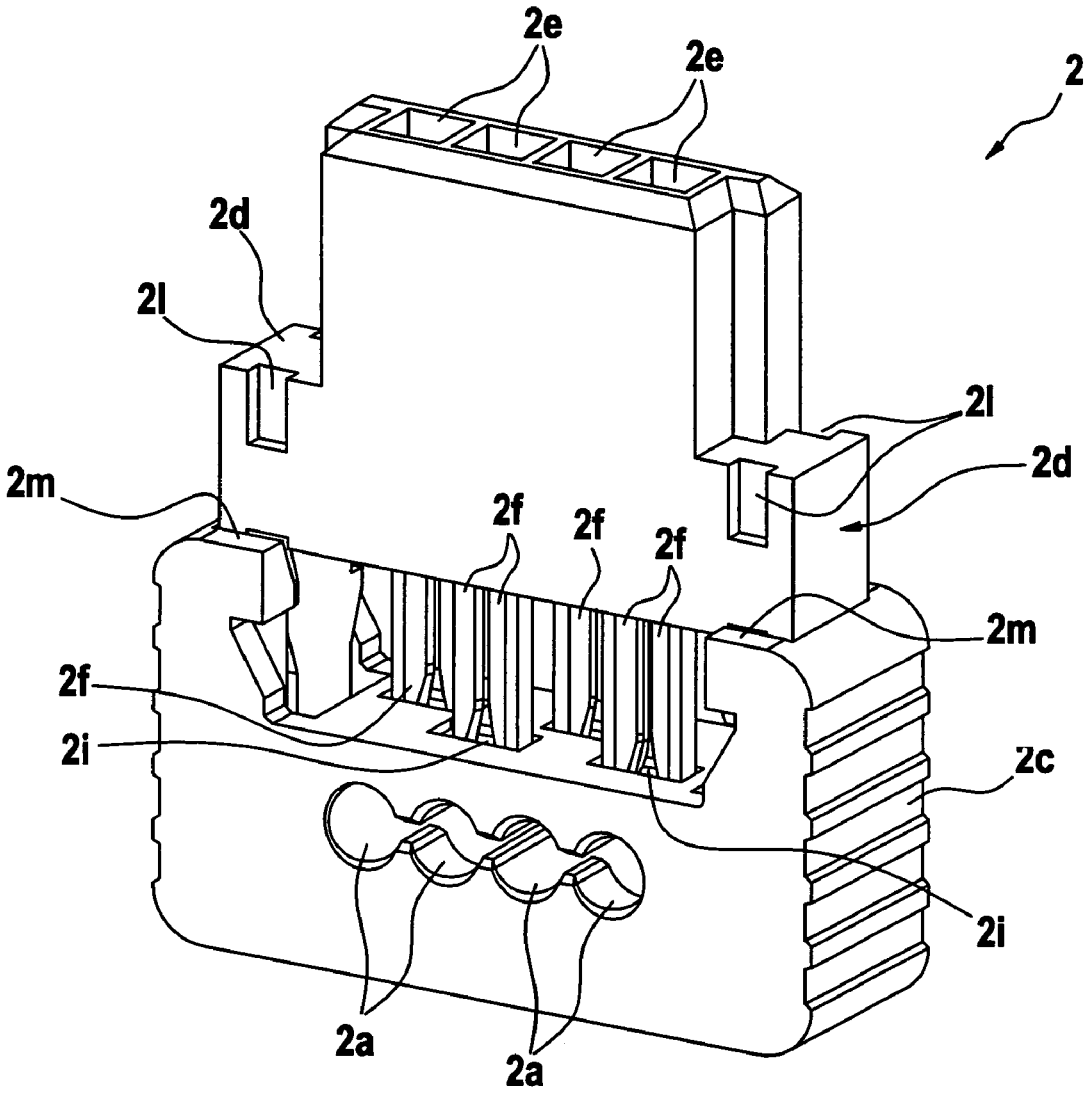
FIG. 4 is a perspective view onto the opposite side of the insulation displacement multipoint connector with a disconnected insulation displacement termination connection.
Figure 5:
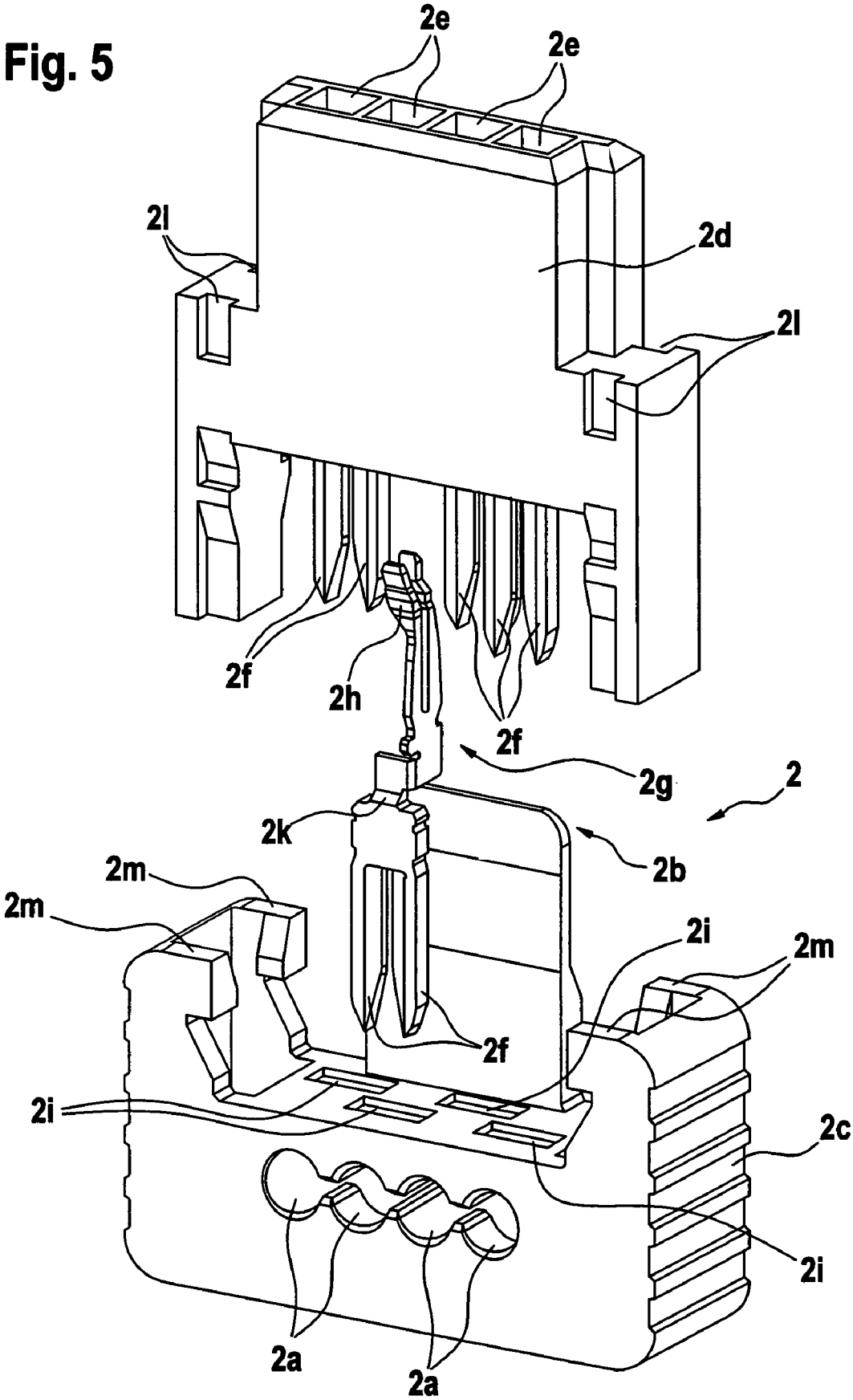
FIG. 5 is a perspective view of the connector according to FIG. 3 shown in the disconnected state.

The insulation displacement multipoint connector 2 is shown in FIG. 4 with a disconnected upper case part 2*d* from the opposite side as in FIG. 3. When the upper case part 2*d* is withdrawn, the insulation displacement terminals 2*f* of the connection elements clear the insertion openings 2*a* for the electrical conductors in the bottom case part 2*c*. As can be seen, the insulation displacement terminals 2*f* of the connection elements are alternatingly arranged in two rows, while the plug-in chambers 2*e* for the plug contacts and thereby also the plug contacts of the connection elements themselves are arranged in a single row with the necessary insulation distance. This is possible due to the wider build of the insulation displacement terminals 2*f* compared with the plug contacts. The necessary insulation distance of the insulation displacement terminals 2*f* is achieved by alternatingly arranging the insulation displacement terminals in two rows. Altogether due to this construction, the insulation displacement multipoint connector 2 and therefore the entire plug connector 1, 2 is relatively narrow compared with such plug connectors known in the art which only have single-rowed insulation displacement terminals and are therefore arranged for a wider build. According to the invention, the plug contacts must not be splayed wide apart. Although the insulation displacement terminals 2*f*, as designed, are arranged in two rows, the insulation displacement multipoint connector 2 and the entire plug connector 1, 2 does not have a deeper build on the whole, since the flat insulation displacement terminals 2*e* 2*f* also arranged alternatingly in two rows do not require more depth than the plug contacts.

FIG. 5 again clarifies in part the idea of the invention. The upper case part 2*d* and the bottom case part 2*c* are separated from each other in this figure. The connection elements 2*g* are located in the upper case part 2*d*, of which only three insulation displacement terminals 2*f* protrude from the upper case part 2*d*. A connection element 2*g* is disassembled for illustration. The plug-in chambers 2*e* in the upper case part 2*d* for the plug contacts 2*h* of the connection elements 2*g*, in the example there are contact springs for the contact blades 1*f* of the multipoint counter connector 1, are arranged in a single row, the insertion openings 2*i* for the insulation displacement terminals 2*f* are arranged alternatingly in two rows. In doing so, the insertion openings 2*i* are moved together at a lateral distance, such that their total length as viewed across the bottom case part 2*c* corresponds to the total length of the plug-in chambers 2*e* across the upper case part 2*d*. The disassembled connection element 2*g* exhibits an approximately centric offsetting 2*k* in the depth of the insulation displacement multipoint connector 1, which makes it possible that the insulation displacement terminal 2*f* finds its insertion opening 2*i* (left insertion opening) in the front row as seen by the observer. Likewise, a further connection element 2*g* is offset for the first row (right insertion opening), which however, is obliterated by the upper case part 2*d* in the figure.

Both the other connection elements 2*g* are designed such that the insertion openings 2*i* are located in the back row as seen by the observer. Usually, these connection elements 2*g* will consequently be offset opposite to both of the other connection elements 2*g*. According to a very practical design of the invention, the connection elements 2*g* are all offset in one direction and then inserted alternatingly pivoted around their longitudinal axis by 180° into the plug-in chambers 2*e* and hooked. In this way one achieves that only a punching and bending tool is required for the production of the connection elements 2*g* and the insulation displacement terminals 2*f* still find their intended insertion openings 2*i* when assembling the upper case part 2*e* and the bottom case part 2*c*. Connection elements which are inserted offset to both directions also make it possible that the two rows of insertion openings 2*i* are located symmetrically to the centerline of the single-rowed plug-in chambers 2*e*, which is advantageous with regard to the minimum required depth of the insulation displacement multipoint connector 2.

The connection elements 2*g* may also have different designs according to the invention. It is possible that only every second connection element 2*g* is offset, and in this case, by the full amount of the row distance of the insertion openings 2*i* in the bottom case part 2*c*. The other connection elements 2*g* are guided without being offset. The place at which the offsettings 2*k* are carried out across the length of a connection element 2*g* depends vastly on the constructional details. In the example, the offsettings 2*k* are effected approximately in the center between the insulation displacement termination area and the plug contact area.

In the example, the connection elements 2*g* bear contact springs at the sides of the plug contact 2*h*. According to a further embodiment, the connection elements 2*g* bear instead contact blades or contact pins. In this case, the multipoint counter connectors 1 have contact springs.

A four-pole plug connector 1, 2 is shown in the example. It goes without saying that the number of poles is not limited to four, rather any number of poles is feasible.

The invention is also not limited to a single-rowed plug connector 1, 2. For example, it is possible to build two-rowed plug connectors for two-rowed multipoint counter connectors, wherein in that case, the insulation displacement terminals 2*f* engage with a total of four rows of insertion openings 2*i* and the connection wires are fed from two sides or from one side in tiers.

For clamping of electrical conductors which are sheathed in plastic without requiring stripping, they must be plugged into the insertion openings 2*a*. Then, the upper case part 2*d* in which the connection elements are attached, and the bottom case part 2*c* are put together, wherein the insulation displacement terminals 2*f* cut into the insulation to the electrical conductor. Since the terminal areas are minimally offset relative to each other, the mechanical stability of the insulation displacement termination connection is increased. Locking contours 2*l*, 2*m* are provided for a robust connection of the upper case part 2*d* with bottom case part 2*c*.

All of the embodiments mentioned either in the above description or only shown in the drawings are additional integral parts of the invention, even if they are not especially emphasized or mentioned in the claims. The invention is not limited to the present design, but may be variable in many cases within the scope of the disclosure.

While specific embodiments of the invention have been described in detail to illustrate the inventive principles, it will be understood that the invention may be embodied otherwise without departing from such principles.

I claim:

1. An insulation displacement multipoint connector for electrical plug connectors, comprising combined connection elements which form at one end thereof an insulation displacement termination area for a connection of electrical conductors without requiring stripping and, at another end, a plug contact area for a multipoint counter connector, wherein the insulation displacement termination area has flat, slotted insulation displacement terminals, the connection elements are designed such that for one row of plug contacts of the connection elements embedded next to each other, the insulation displacement terminals of these connection elements are located in several rows in the insulation displacement multipoint connector, the plug contacts of the connection elements are located in a row next to each other in the insulation displacement multipoint connector and the insulation displacement terminals of the connection elements are in arranged two rows, and wherein the insulation displacement terminals of the connection elements are alternatingly located in two rows in the insulation displacement multipoint connector and the connection elements are inserted with regard to their plug contacts alternatingly offset in opposite directions within a connection element row, wherein the insulation displacement multipoint connector has a two-part case comprising an upper and a bottom case part which can be put together, wherein the connection elements are fastened in the upper case part and the insulation displacement terminals are inserted into the bottom case part.

2. The insulation displacement multipoint connector according to claim 1, wherein identically offset connection elements are inserted alternatingly pivoted by 180° around their longitudinal axes into the insulation displacement multipoint connector.

3. The insulation displacement multipoint connector according to claim 1, wherein only every second connection element of the connection element row is offset in the same direction with regard to its plug contacts and the other connection elements are not offset.

4. The insulation displacement multipoint connector according to claim 1, wherein the offsettings are located approximately centrically in the area of the connection elements.

5. The insulation displacement multipoint connector according to claim 1, wherein insertion openings arranged in the bottom case part in multiple rows for the insulation displacement terminals intersect with or overlap each other in the direction of alignment.

6. The insulation displacement multipoint connector according to claim 1, wherein the case parts are locked together by locking contours arranged laterally in broad sides of the body of the upper case part.

7. The insulation displacement multipoint connector according to claim 1, wherein the plug contacts of the connection elements form two-armed contact springs.

8. The insulation displacement multipoint connector according to claim 1, wherein the plug contacts of the connection elements form contact blades or contact pins.

9. The insulation displacement multipoint connector according to claim 1, wherein the number of poles is discretionary.

10. The insulation displacement multipoint connector according to claim 1, wherein the plug connector has two or more rows.

11. The insulation displacement multipoint connector according to claim 1, wherein the multipoint counter connector has a case trough made of insulation material.

12. The insulation displacement multipoint connector according to claim 11, wherein at least one snap-in slot is provided in the case trough of the multipoint counter connector into which at least one notch of the bottom case part of the insulation displacement multipoint connector locks in the plugged state.

13. The insulation displacement multipoint connector according to claim 12, wherein the case trough of the multipoint counter connector has two fastening clamps which interlock with the snap-in slots behind the locking contours at the narrow sides of the case trough.

14. The An insulation displacement multipoint connector for electrical plug connectors, comprising combined connection elements which form at one end thereof an insulation displacement termination area for a connection of electrical conductors without requiring stripping and, at another end, a plug contact area for a multipoint counter connector, wherein the insulation displacement termination area has flat, slotted insulation displacement terminals, the connection elements are designed such that for one row of plug contacts of the connection elements embedded next to each other, the insulation displacement terminals of these connection elements are located in several rows in the insulation displacement multipoint connector, the plug contacts of the connection elements are located in a row next to each other in the insulation displacement multipoint connector and the insulation displacement terminals of the connection elements are in arranged two rows, and wherein the insulation displacement terminals of the connection elements are alternatingly located in two rows in the insulation displacement multipoint connector and the connection elements are inserted with regard to their plug contacts alternatingly offset in opposite directions within a connection element row, wherein the insulation displacement multipoint connector has a two-part case comprising an upper and a bottom case part which can be put together, wherein the connection elements are fastened in the upper case part and the insulation displacement terminals are inserted into the bottom case part, wherein a notch provided on the insulation displacement multipoint connector which serves the locking of the insulation displacement multipoint connector with the multipoint counter connector, is arranged in one of the broad sides of the body of the bottom case part, wherein the notch does not protrude beyond the surface of this broad side of the insulation displacement multipoint connector.

15. The insulation displacement multipoint connector according to claim 14, wherein a recess is provided corresponding to the position of the notch in the bottom case part in the upper case part of the insulation displacement multipoint connector, wherein a space is formed between the surfaces of this recess and the notch which face each other, so that the notch can carry out a transverse motion.

* * * * *